US008414818B2

(12) United States Patent
Honnefeller et al.

(10) Patent No.: US 8,414,818 B2
(45) Date of Patent: Apr. 9, 2013

(54) METHOD FOR MAKING BRISTLES FOR A HAIRBRUSH

(75) Inventors: Katja Honnefeller, Friedrichsdorf (DE); Jürgen Seng, Kelkheim (DE); Michael Klöppel-Riech, Friedberg (DE)

(73) Assignee: Braun GmbH, Kronberg (DE)

( * ) Notice: Subject to any disclaimer, the term of this patent is extended or adjusted under 35 U.S.C. 154(b) by 0 days.

(21) Appl. No.: 12/743,944

(22) PCT Filed: Nov. 26, 2008

(86) PCT No.: PCT/EP2008/009995

§ 371 (c)(1),
(2), (4) Date: May 20, 2010

(87) PCT Pub. No.: WO2009/083077

PCT Pub. Date: Jul. 9, 2009

(65) Prior Publication Data

US 2010/0282268 A1 Nov. 11, 2010

(30) Foreign Application Priority Data

Dec. 29, 2007 (DE) ..... 10 2007 063 154

(51) Int. Cl.
*B29C 45/00* (2006.01)
*B29C 45/44* (2006.01)
*B29C 45/03* (2006.01)

(52) U.S. Cl.
USPC ..... 264/328.1; 264/318; 264/334; 425/330; 425/805

(58) Field of Classification Search ..... None
See application file for complete search history.

(56) References Cited

U.S. PATENT DOCUMENTS 2,621,369 A 12/1952 Gantz
2,651,810 A 9/1953 Snyder
(Continued)

FOREIGN PATENT DOCUMENTS

DE 2155888 11/1970
DE 3400941 1/1983
(Continued)

*Primary Examiner* — Edmund H. Lee
(74) *Attorney, Agent, or Firm* — Kim William Zerby

(57) ABSTRACT

The invention relates to a hairbrush, bristles for use in a hairbrush and a method of producing a hairbrush and such bristles. The invention discloses in particular a method of producing a bristle, in which mouldable material is introduced into a multi-part mould which can be separated into its individual parts, and a bristle having a bristle head, a bristle shank and a bristle foot is produced and a bristle shank is moulded using a first mould part, wherein mouldable material is introduced into a first cavity of the first mould part and subsequently removed from the first cavity of the first mould part, wherein the first cavity of the first mould part is maintained and the bristle foot is moulded using a second mould part and a third mould part, wherein the second and third mould parts together form a second cavity, of which the shape corresponds essentially to the shape of the bristle foot which is to be moulded, and the second cavity is filled with the mouldable material and the second and the third mould parts are subsequently separated, and the bristle head is moulded using a fourth mould part and fifth mould part, wherein the fourth and fifth mould parts together form a third cavity, of which the shape corresponds essentially to the shape of the bristle head which is to be moulded, and the third cavity is filled with the mouldable material and the fourth and the fifth mould parts are subsequently separated.

8 Claims, 4 Drawing Sheets

U.S. PATENT DOCUMENTS

Figure 1:
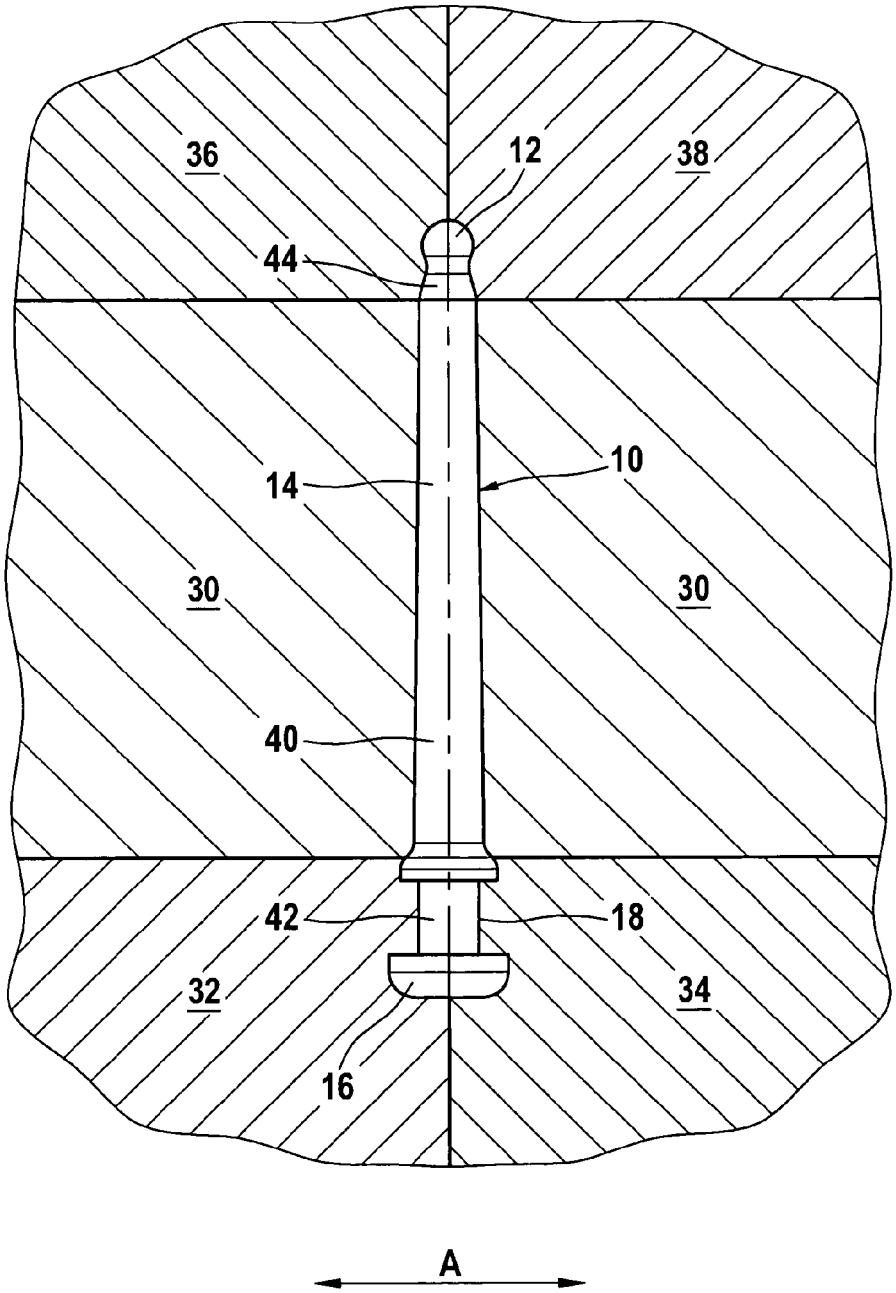

| | | | | | |
|---|---|---|---|---|---|
| 3,577,843 | A | * | 5/1971 | Kutik et al. | 425/547 |
| 3,781,402 | A | | 12/1973 | Hanggi | |
| 4,244,076 | A | * | 1/1981 | Meyer | 15/188 |
| 4,422,986 | A | * | 12/1983 | Cole | 264/39 |
| 4,603,831 | A | * | 8/1986 | Krishnakumar et al. | 249/144 |
| 5,352,025 | A | | 10/1994 | Huang | |
| 5,490,966 | A | * | 2/1996 | Peterson et al. | 264/318 |
| 5,531,582 | A | * | 7/1996 | Klinkhammer | 425/190 |
| 5,771,904 | A | | 6/1998 | Lange | |
| 6,638,384 | B1 | | 10/2003 | Edwards et al. | |
| 6,767,494 | B1 | * | 7/2004 | Robinson | 264/318 |
| 7,226,555 | B2 | | 6/2007 | Coronet | |
| 7,294,297 | B2 | * | 11/2007 | Weihrauch | 264/102 |
| 7,419,626 | B2 | * | 9/2008 | Mark | 264/243 |
| 7,644,466 | B2 | * | 1/2010 | Weihrauch et al. | 15/207.2 |
| 7,951,320 | B1 | * | 5/2011 | Swanson et al. | 264/328.1 |
| 2003/0163884 | A1 | | 9/2003 | Weihrauch | |
| 2010/0269841 | A1 | | 10/2010 | Honnefeller et al. | |

FOREIGN PATENT DOCUMENTS

| | | |
|---|---|---|
| EP | 1491113 | 6/2003 |
| GB | 622532 | 3/1947 |
| GB | 601371 | 5/1948 |
| JP | 61115536 | 11/1984 |
| JP | 62039531 | 3/1985 |
| JP | 6190418 | 6/1986 |
| JP | 3009262 | 8/1991 |
| JP | 05-146311 | 11/1991 |
| JP | 443129 | 4/1992 |
| JP | 3008320 | 5/1994 |
| JP | 10108732 | 10/1996 |
| JP | 06-154027 | 11/1999 |
| JP | 200455351 | 7/2002 |
| JP | 3099422 | 7/2003 |
| JP | 2005238642 | 2/2004 |

* cited by examiner

METHOD FOR MAKING BRISTLES FOR A HAIRBRUSH

The invention relates to a hairbrush, bristles for use in a hairbrush, and method for the production of a hairbrush and such bristles. The invention can be used in a multiplicity of completely different hairbrushes. It is even possible for the bristles described herein to be used in brushes that are not used or are not predominantly used for the brushing of hair. In particular it is also suitable for the bristles to be used in a massage brush. Their use is likewise possible in a hair care device that additionally heats the hair, for instance by means of hot air or a hot contact surface. Corresponding devices are marketed as so-called stylers or curlers.

GB 601,371 (Denman) discloses a hairbrush with non-metallic bristles. The bristles taper towards the tip and have a bristle foot that allows their firm anchoring in a rubber mat, in that the bristles with the tip are first pushed through openings in the mat, and pressure is exerted on the bristle feet from the brush side by means of an corresponding brush body.

A method for the production of bristles is known from DE 2155888. A multi-part separable mold part is disclosed there with which a bristle with a bristle foot and a bristle shaft can be molded. The method enables bristle shafts to be produced that are at least in principle flash-free, but require a laborious stretching and a complex mold part. In spite of the complexity of this mold part, however, freely selectable shapes for the bristle foot or bristle head cannot be produced.

The object of the present invention is to offer bristles and brushes as well as methods for their production that are improved with respect to prior art. The bristles and brushes should have a particularly gentle effect on hair and scalp. The production methods are to be suitable for mass production; they should be cost-effective and produce little waste. In particular the methods should provide bristles and brushes that are safe and gentle for use, even if production standards are not perfect.

These objects are achieved by a method for the production of a bristle according to claim 1, by a method for the production of a brush according to claim 9, and by a bristle according to claim 10 or 11, as well as a hairbrush according to claim 14. Preferred embodiments, by means of which the objects are achieved particularly well, are described in the Subclaims.

The use of a multi-part mold part that can be separated allows optimized mold cavities to be made available for different bristle parts. The bristle shaft blank is molded in the mold cavity of a separate mold part. To this end moldable material is introduced into the mold, which for this purpose as a rule has an air outlet channel opposite to the feed opening for the moldable material. The mold cavity will usually taper away from the feed opening, i.e. the mold cavity has a smaller cross-section at a point further away from the feed opening. Accordingly the bristle shaft blank is generally molded in such a way that it tapers in the direction of the bristle head.

The invention is suitable for the molding of bristles made of all current moldable materials, i.e. all suitable plastics, and in particular polyamides. A preferred material is aliphatic polyamides, in particular those that are commercially available as "nylon". Such aliphatic polyamides are relatively insensitive to heat, which allows the bristles to be used in a hairbrush while the hair is heated, for instance by a hair dryer.

However, it is known in particular for the preferred aliphatic polyamides that they tend to form a flash readily, since they flow particularly well in multi-part mold parts. Therefore if the mold cavity for the bristle shaft were to be formed in a two- or multi-part mold part, a flash would remain behind when demolded. However, such a flash on the bristle shaft damages the hair and in addition soil collects there readily. This leads to a hairbrush that is not very hygienic and not very gentle.

The after-treatment of a bristle shaft would be conceivable, for example by deflashing. One possibility for deflashing is the treatment of molded bristle shafts with abrasive agents. However, this step is time-consuming and expensive and can also lead to an increased roughness at other points of the bristle shaft. Alternatively or in addition, the bristle shaft could be frozen for the purpose of deflashing. The very tough aliphatic polyamide material can be deflashed more easily by freezing. However, this step is obviously likewise expensive.

According to the method presented, the bristle foot is molded with two mold parts, which together form a mold cavity. This mold cavity, which is formed from two mold parts, corresponds essentially to the shape of the bristle foot to be molded. It is filled with the moldable material and the two mold parts are subsequently separated.

Generally, the bristle foot is formed of the same moldable material as the bristle shaft. The mold cavities for bristle shaft and bristle foot thereby form a connected mold cavity, which is filled with a moldable material in one step. However, the molding of bristle shaft and bristle foot from a different material is also conceivable.

According to the method presented, the bristle head is likewise molded with two mold parts that together form a mold cavity. This mold cavity, which is formed from two mold parts, corresponds essentially to the shape of the bristle head to be molded. It is filled with the moldable material and the two mold parts are subsequently separated.

Generally, the bristle head is formed from the same moldable material as the bristle shaft and/or bristle foot. The mold cavities for bristle shaft and bristle head thereby form a connected mold cavity, which is filled with a moldable material in one step. However, the molding of bristle shaft and bristle foot from a different material is also conceivable.

For the removal of the bristle shaft from its mold part, it can be moved away along the axis of the formed bristle relative to the mold parts that hold the bristle foot. Then the two mold parts that hold the bristle foot are separated. This movement of the mold parts enables a simple removal of the bristles without additional devices.

However, with a bristle shaft that tapers in an axial direction, the removal direction is determined by this tapering. Generally, the bristle shaft will taper in the direction of the bristle head. The removal from the mold then should take place in the direction of the bristle foot. In a method by way of example, therefore, the two mold parts that have molded the bristle head are first released. Then the two mold parts that have molded the bristle foot are moved relative to the mold part for the bristle shaft. Then the two mold parts that have held the bristle foot are moved apart from one another so that the bristle is situated completely outside the mold. Particularly with this removal method, it is advantageous if the bristle head is not too thick. In particular, a method is possible in which the largest diameter of the bristle head measured radially to the longitudinal axis of the bristle is smaller than the smallest diameter of the bristle shaft measured radially to the longitudinal axis of the bristle. In particular the largest diameter of the bristle head measured radially to the longitudinal axis of the bristle can be smaller than the smallest diameter of the bristle shaft measured radially to the longitudinal axis of the bristle by a factor of at least 0.5 or 0.75 or 0.8 or 0.9. With such a method the bristle material can be largely or completely inelastic, since the geometry of the bristle in no way prevents the removal. However, if a sufficiently elastic material is used, the diameter of the bristle head can also be greater than the diameter of the bristle shaft (respectively measured as above).

Due to its advantages in the production method, as well as to its advantages in use, a bristle is also advantageous in which the largest diameter of the bristle head measured radially to the longitudinal axis of the bristle is smaller than the smallest diameter of the bristle shaft measured radially to the longitudinal axis of the bristle.

It must be taken into account that brushes are a reasonably priced regularly replaced article of daily use. Thus a brush should not be too expensive. Therefore with the enormous number of bristles to be produced, it is particularly important that a reasonably priced mass production method be taken into account. Mold part that can be separated, which together form a mold cavity, regularly leave behind a small flash along the parting line. In high-quality and new mold parts, this flash is small. However, particularly in a reasonably priced mass production it is also necessary to use reasonably priced mold parts over a certain service life. This leads to distinct flashes, which have the disadvantages described above when used as a hairbrush.

On the other hand, the molding of the bristle shaft together with the bristle foot in a single mold part is not without other difficulties. The bristle shaft must then taper over its entire length and the bristle foot must also do this, so that a complex bristle shape cannot be produced. A simple bristle shape of this type, as is also known from GB 601,371 (Denman), however, leads to certain additional requirements for the brush. Denman discloses a relatively complex brush body, in which the bristles are supported over their entire surface. Although the bristles can bend sideways, they cannot bend back onto the brush along their longitudinal axis. Such a bending back of the bristles, i.e. a resilient mounting, however, is considerably gentler for instance for the scalp, when the brush is used as a hairbrush.

The present method allows bristles to be produced for a resilient mounting of this type. The resilient mounting of the bristles can be achieved if the bristle foot has an undercut with which the bristle foot can be fixed both on the upper side and also on the underside of a support material.

Such a support material can for instance be an elastic rubber mat, which is set in the bristle body in an elastically pretensioned manner. This rubber mat then imparts a resilient elasticity to each individually inset bristle. The bristles can bend back along their longitudinal axis (and again be pressed in the direction of the hair by resilient elasticity) and also can yield in each axial direction thereto. The ability to design a complex molded bristle foot therefore allows gentler brushes to be produced.

The bristle shape, which is complex compared to the Denman bristles, allows a simpler brush shape, but one that nevertheless enables a gentle combing. Moreover the bristles have only a few flash-containing areas. The bristle shaft, which is flash-free over its entire length, is gentle to the hair.

The method for producing a bristle can also include further steps. In particular it is possible to work the profile of the bristle shaft blank further. Such a working can comprise coloring, sanding, smoothing, or polishing of the bristle shaft blank. In particular the working of the bristle shaft blank in the area of its head is also possible.

It is also possible in a further production step to provide the bristles with a covering material at the bristle head. In particular it is possible to provide the bristle heads with varnish, for instance in the form of small drops of varnish that produces a thickening and rounding of the bristle head.

Such varnished bristle ends are known. However, with lengthy use of bristles and brush, they regularly lead to the problem that the covering material falls off the bristle. This problem can be combated by providing a bristle head with a suitable profile. In the described method, the third mold cavity can be designed independently of the other mold cavities, in order to select the profile in a suitable manner Bristles whose bristle head has an undercut or a constriction are well-suited.

The method can therefore be used advantageously to produce at least one bristle that includes a bristle foot, a bristle shaft, and a bristle head of respectively different profile, and in which the bristle foot has an undercut, the bristle shaft is flash-free, and the bristle head has a bristle head covering.

In particular a bristle is also suitable that includes a bristle foot, a bristle shaft, and a bristle head of respectively different profile, and in which the bristle foot has an undercut, the bristle shaft is flash-free, and the bristle head has a bristle head covering, and the largest diameter of the bristle head measured radially to the longitudinal axis of the bristle is smaller than the smallest diameter of the bristle shaft measured radially to the longitudinal axis of the bristle. In particular the largest diameter of the bristle head measured radially to the longitudinal axis of the bristle can be smaller by a factor of at least 0.5 or 0.75 or 0.8 or 0.9 than the smallest diameter of the bristle shaft measured radially to the longitudinal axis of the bristle. In such a bristle, the bristle head can also have a neck or an undercut.

The present method allows bristle heads of any shape to be configured in a separate mold part. In the molding by means of the two shared mold parts, however, in any case under certain circumstances of mass production, a flash can arise. It is possible to design the bristle head covering such that the bristle is particularly gentle even when weakening in the production method. In this context it is possible to design the bristle head covering such that it completely surrounds the bristle head, in so far as it was in the third mold cavity. Typically the bristle head covering thereby surrounds not only the end of the bristle head, frequently in the form of a sphere, but also the upper part of the shaft. It is possible for the bristle head covering to extend axially for a certain length. In particular a bristle can be advantageous in which the bristle head extends axially over a first length ($l_k$) and the bristle head covering extends axially over a second length ($l_h$) and the second length ($l_h$) is greater than the first length ($l_k$) by a factor of at least 1.2 or 1.5 or 2 or 2.5.

The method can be used to provide bristles with a bristle head covering in which the largest diameter of the bristle head covering (20) measured radially to the longitudinal axis of the bristle is greater than the smallest diameter of the bristle shaft (14) measured radially to the longitudinal axis of the bristle. In particular the largest diameter of the bristle head covering measured radially to the longitudinal axis of the bristle can be greater than the smallest diameter of the bristle shaft measured radially to the longitudinal axis of the bristle by a factor of at least 1.1 or 1.25 or 1.5 or 2.0 or 2.5.

The method for the production of bristles can be part of a production method for brushes. A method for the production of a brush is possible in which bristles are produced in a method according to one of the preceding claims, and these bristles with their bristle foot are inset into a bristle support cushion and the bristle support cushion is used in a brush.

A hairbrush that was produced according to one of the methods described here can also include additional hair treatment devices. In particular it is possible for the hairbrush to additionally include an ion applicator. Such an ion applicator can counteract the static charge of the hair. Hair is typically positively charged, so that the application of negative ions on the hair is useful. Such an ion applicator can be line-powered or battery-powered. For a particularly gentle and handy hairbrush, a battery-operated applicator for negative ions is suitable.

This and further features of the invention are shown not only by the claims but also by the following description and/or the associated drawings, wherein the features can form the subject matter of the invention in various combinations and sub-combinations together as well as individually, notwithstanding their inclusion in the claims. The invention is described in more detail below based on preferred exemplary embodiments and associated drawings. The drawings show:

FIG. 1 A longitudinal section through the mold parts along the longitudinal central axis of a bristle.

Figure 2:
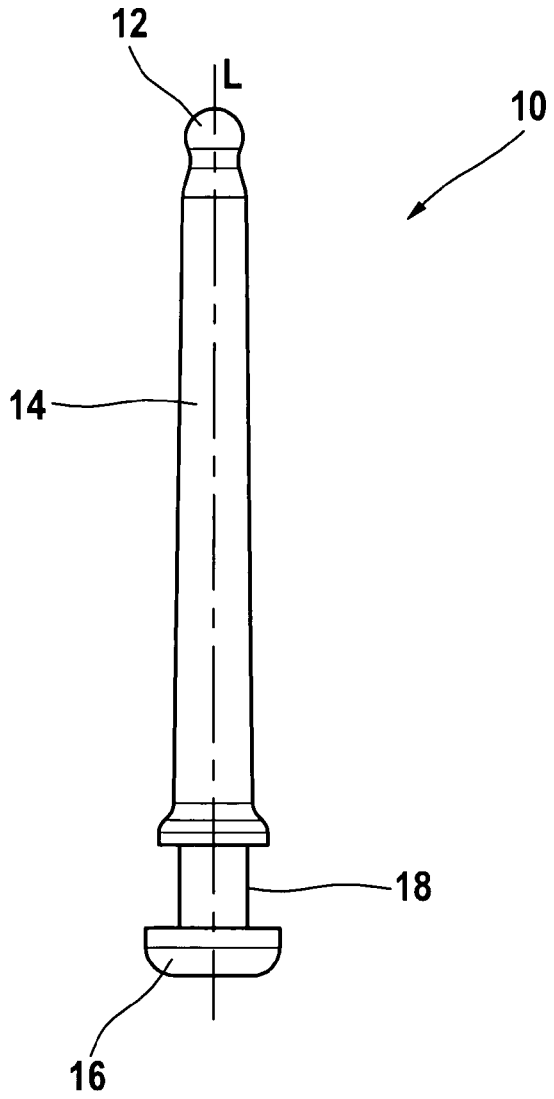

FIG. 2 A longitudinal section through a bristle according to the invention.

Figure 3:
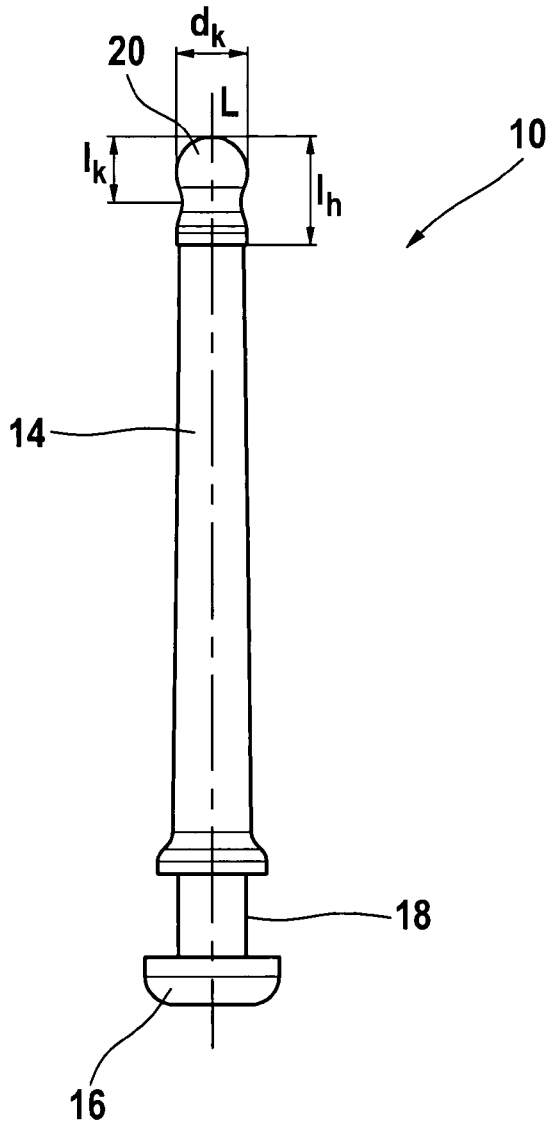

FIG. 3 A longitudinal section through a bristle according to the invention that has a bristle head covering.

Figure 4:
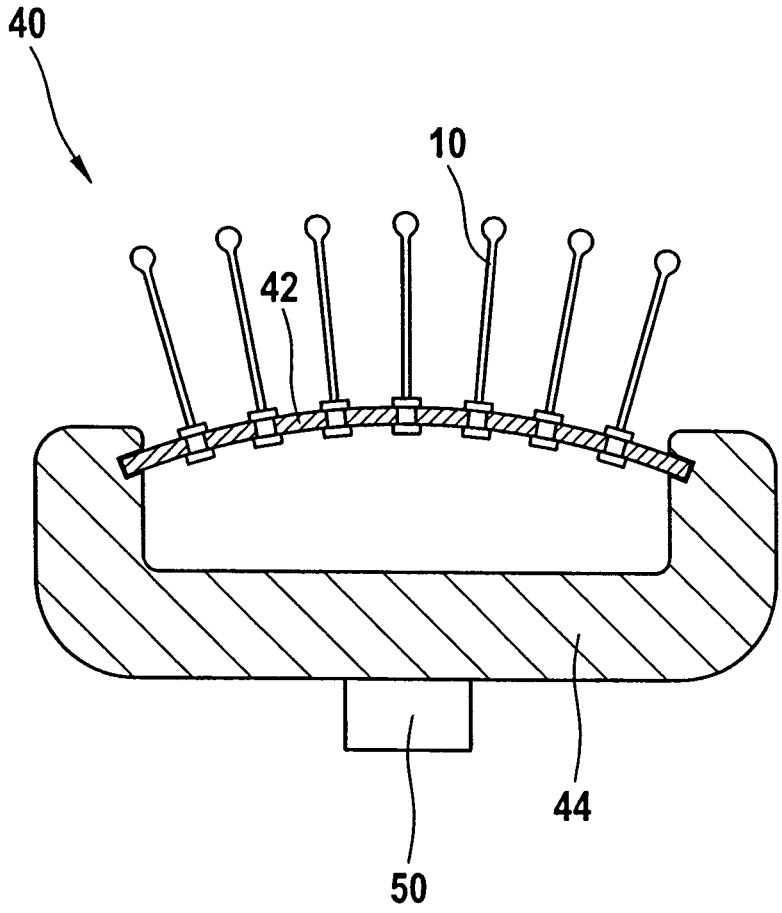

FIG. 4 A cross-section through a brush.

FIG. 1 shows a longitudinal section of a bristle (10) in a mold part. The longitudinal section is selected along the longitudinal axis (L) of the bristle. The bristle head (12), the bristle shaft (14) and the bristle foot (16) are visible. The bristle shaft (14) is formed in a first mold part (30). The bristle foot (16) is formed between a second mold part (32) and a third mold part (34), which jointly provide a second mold cavity (42). The mold cavity (42) is designed so that the bristle foot (16) has an undercut (18). The bristle head is formed between the fourth mold part (36) and the fifth mold part (38), which jointly provide the third mold cavity (44). The removal of the bristle from the mold parts can take place in that first the fourth mold part (36) and the fifth mold part (38) are moved apart from one another in the axial direction (A) and thereafter the second mold part (32) and the third mold part (34) are moved away from the first mold part (30) in the longitudinal direction of the bristle (L). Then the second mold part (32) and the third mold part (34) are also moved apart along the axis (A).

FIG. 2 shows a bristle (10) that can be produced according to the method disclosed here. The bristle (10) has a flash-free bristle shaft (14) that is limited upwards by a bristle head (12) and downwards by the bristle foot (16). The bristle shaft (14) tapers towards the bristle head (12) between the bristle foot (16) and the bristle head (12). The bristle foot (16) has an undercut (18). With this undercut (18), the bristle (10) can be anchored in a bristle support. The bristle head is thereby designed essentially axial-symmetrically to the longitudinal axis (L) of the bristle.

FIG. 3 shows another bristle (10) with a bristle head covering. Its shape corresponds essentially to the bristle of FIG. 2. However, a bristle head covering (20) is additionally applied to the bristle head (12). This leads to a thickening of the head compared to the bristle shaft (14), which promotes a gentle hair and skin treatment. The bristle head diameter ($d_k$), which actually is to be determined in the radial direction to the longitudinal axis, with a spherical head profile as shown can also be measured in a different direction. With this round head shape, the first length ($l_k$) can conveniently be determined between the upper end of the bristle head and the level of the narrowest constriction between bristle head and bristle shaft.

FIG. 4 shows a cross-section through a brush that goes through the bristle field of the brush (40). In this cross-section the bristle support (42) and the brush body (44) are seen in which the bristle support (42) is inset. The bristle support (42) can be inset in a resiliently pretensioned manner, so that the bristles (10) contained in the bristle support (42) are mounted in a resiliently elastic manner with respect to the bristle body (44). The bristles (10) can move along their respective longitudinal axes towards the brush body (44) and can move back again resiliently in the direction of the hair, for instance. They can also move in an axial direction.

The brush (40) shown is additionally provided with an ion applicator (50). The ion applicator is attached at the back of the brush body, therefore is turned away from the bristle support (42) at the side.

What is claimed is:

1. A method for the production of a bristle (10) for use in a hairbrush (40), in which moldable material is introduced into a multi-part mold that can be separated, and a bristle (10) with a bristle head (12), a bristle shaft (14), and a bristle foot (16) is produced, said method comprising a bristle shaft (14) is molded with a first mold part (30), wherein moldable material is introduced into a first mold cavity (40) of the first mold part (30) and is subsequently removed from the first mold cavity (40) of the first mold part (30), wherein the first mold cavity (40) of the first mold part (30) is maintained and the bristle foot (16) is molded in a second mold part (32) and a third mold part (34), wherein the second and third mold parts together form a second mold cavity (42) whose shape essentially corresponds to the shape of the bristle foot (16) to be molded, and the second mold cavity (42) is filled with the moldable material, and the second and the third mold parts are subsequently separated, and the bristle head (12) is molded in a fourth mold part (36) and a fifth mold part (38), wherein the fourth and fifth mold parts together form a third mold cavity (44) whose shape essentially corresponds to the shape of the bristle head (12) to be molded, and the third mold cavity (44) is filled with the moldable material, and the fourth and the fifth mold parts are subsequently separated prior to removing the bristle from the mold.

2. The method according to claim 1, in which the largest diameter of the bristle head (12) measured radially to the longitudinal axis of the bristle is smaller than the smallest diameter of the bristle shaft (14) measured radially to the longitudinal axis of the bristle.

3. A method according to claim 1 in which the bristle (10) is further worked.

4. A method according to claim 3, in which the bristle (10) is further worked in the area of the bristle head (12).

5. A method according to claim 4, in which the profile of the bristle shaft blank is provided with a bristle head covering (20) in the area of the head.

6. A method according to claim 5, in which the bristle head covering (20) completely coverings the bristle head (12), in so far as it was in the third mold cavity (44).

7. A method according to claim 5 in which the largest diameter of the bristle head covering (20) measured radially to the longitudinal axis of the bristle is larger than the smallest diameter of the bristle shaft (14) measured radially to the longitudinal axis of the bristle.

8. A method according to claim 7 in which an undercut (18) is provided at the bristle foot (16).

* * * * *